US011249444B2

(12) United States Patent
Blanckaert et al.

(10) Patent No.: US 11,249,444 B2
(45) Date of Patent: Feb. 15, 2022

(54) DISPLAY ASSEMBLY

(71) Applicant: The Swatch Group Research and Development Ltd, Marin (CH)

(72) Inventors: Nicolas Blanckaert, Boudry (CH); Jerome Thiault, Colombier (CH); Cyrille Gernez, Boudry (CH); Pierry Vuille, Les Emibois (CH); Ariane Gachet-Mueller, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 205 days.

(21) Appl. No.: 16/034,904

(22) Filed: Jul. 13, 2018

(65) Prior Publication Data

US 2019/0018372 A1 Jan. 17, 2019

(30) Foreign Application Priority Data

Jul. 14, 2017 (EP) ..... 17181521

(51) Int. Cl.
*G04B 19/30* (2006.01)
*G04G 9/00* (2006.01)

(52) U.S. Cl.
CPC ..... *G04G 9/0017* (2013.01); *G04B 19/30* (2013.01)

(58) Field of Classification Search
CPC ..... G04G 9/00; G04G 9/0017; G04B 19/30; H01H 9/165
USPC ..... 116/48, 49, 250
See application file for complete search history.

(56) References Cited

U.S. PATENT DOCUMENTS 5,984,485 A * 11/1999 Poli ..... G04B 19/30 362/23.15
7,883,255 B2 * 2/2011 Winkler ..... G04B 19/30 362/23.01
10,108,149 B2 * 10/2018 Kang ..... G04G 17/045
2007/0109918 A1 5/2007 Furetta et al.
2012/0082012 A1 * 4/2012 Blanckaert ..... G04B 37/225 368/224
2015/0378319 A1 * 12/2015 Yamakawa ..... G04B 19/30 368/227

(Continued)

FOREIGN PATENT DOCUMENTS

CH 702 419 A2 6/2011
CN 1297172 A 5/2001
CN 105278315 A 1/2016

(Continued)

OTHER PUBLICATIONS

European Search Report dated Feb. 2, 2018 in European Application 17181521.0 filed on Jul. 14, 2017 (with English Translation of Categories of Cited Documents).

(Continued)

*Primary Examiner* — Sean Kayes
(74) *Attorney, Agent, or Firm* — Oblon, McClelland, Maier & Neustadt, L.L.P.

(57) ABSTRACT

The present invention concerns a display assembly comprising an organic light-emitting diode display device comprising at least one OLED comprising an emitting stack placed on a transparent substrate, whose back face is placed on the emitting surface of the OLED, and a secondary object to be illuminated, said transparent substrate comprising a front face and at least one side face arranged to light a secondary object.

12 Claims, 2 Drawing Sheets

(56) References Cited

U.S. PATENT DOCUMENTS

| | | | |
|---|---|---|---|
| 2016/0126481 | A1 | 5/2016 | Lecamp et al. |
| 2016/0363909 | A1 | 12/2016 | Kang et al. |

FOREIGN PATENT DOCUMENTS

| | | | |
|---|---|---|---|
| EP | 1 780 615 | A1 | 5/2007 |
| EP | 2 814 078 | A1 | 12/2014 |
| JP | 9-49887 | A | 2/1997 |
| JP | 2001-99952 | A | 4/2001 |
| JP | 2001-296374 | A2 | 10/2001 |
| JP | 2004-198681 | A2 | 7/2004 |
| JP | 2016-11856 | A | 1/2016 |

OTHER PUBLICATIONS

Chinese Office Acton issued in Chinese Patent Application No. 201810764665.8 dated Nov. 5, 2020 (w/ English translation).
Japanese Office Action issued in Japanese Patent Application No. 2018-130456 dated Oct. 13, 2020 (w/ English translation).

* cited by examiner

DISPLAY ASSEMBLY

This application claims priority from European patent application No. 17181521.0 filed on Jul. 14, 2017, the entire disclosure of which is hereby incorporated herein by reference.

FIELD OF THE INVENTION

The present invention relates to a display assembly and more specifically an OLED display assembly intended to light a passive display device, for example in a timepiece such as a watch.

BACKGROUND OF THE INVENTION

In the watch industry, an increasing number of devices combine a conventional mechanical display using hands with a digital display, for example for applications connected to a smart phone, or to any other object provided with communication means.

In such devices, the digital display, when it is a backlit display, is switched on only on demand, in order to reduce the electrical power consumption of the system, whereas the mechanical display is purely passive and therefore cannot be read in the dark without a Superluminova® type coating. These phosphorescent coatings do not perform well enough for some applications (for a date disc, for example) because of the small surface area coated, but also because of the excess thickness created.

In a digital display of the prior art however, the light is emitted forwards and does not light other objects in the same plane or slightly set back from the front face of the display.

Moreover, it is known that the efficiency of light emitting diode (LED) devices, including those with organic active layers (OLED in English or DELo in French) generally used for lighting these displays, is greatly limited by optical efficiency, due to the difficulty in extracting light from a highly refractive medium to a weak refractive medium. This low efficiency is mainly due to the total internal reflection of the light emitted by the active layer. Indeed, unlike lasers where coherent light is highly oriented by the resonant cavity, light is emitted isotropically in LEDs. As a result of this isotropy, light emitted at an angle to the extraction surface normal higher than the critical angle undergoes total reflection, which traps this light in its substrate. This trapped light can represent up to 80% of emitted light for a substrate that has not been optimised.

To enhance the optical efficiency of digital displays, various strategies for texturing the extraction surface have been proposed in the prior art surface depolishing, regular structures of 'optical' films optimised for light extraction, semi-cylindrical 'domes' above the active zones (pixels).

However, to date, regardless of the extraction device, a non-negligible proportion of the light emitted at the LED junction remains trapped and is lost inside the light guide formed by the substrate and, where appropriate, in the different layers that make up the OLED.

SUMMARY OF THE INVENTION

The present invention concerns a display assembly including an organic light-emitting diode display device (OLED), comprising at least one OLED formed of an emitting stack placed on a transparent (or semi-transparent or translucent) substrate whose back face is placed on the main emitting surface of the OLED and a secondary object to be illuminated, said substrate including a front face and at least one side face, said side face being arranged to light a secondary object.

The display assembly is particularly suited to being incorporated in a watch, in which the main surface, which may include an integrated or added decoration and which can be produced by various known techniques (pad printing, silk screen printing, digital printing, transfer printing, etc. . . . ), forms the face of a watch dial capable of displaying information transmitted to the user, a secondary object arranged in proximity to the side face which can be illuminated by the light trapped between the front faces of the substrate when it exits through the side face of the substrate. Typically, this recovered light can advantageously be used to light a passive analogue display arranged in proximity to the side face. When the OLED display device forms a watch dial, a through opening can be arranged in the thickness of said dial to form an aperture and advantageously the OLED display device can be combined with a passive analogue display device of the date display type, wherein the date disc moves underneath the aperture and wherein the information borne by the date disc seen through the aperture can be illuminated by the light extracted from the side walls of the aperture. The display device can also light a secondary object arranged in proximity to the side face and substantially in the same plane as the substrate.

Preferably, said side face is frosted to produce a diffused light during use.

Advantageously, said side face is at an angle of between 90 and 135° relative to the front face.

Advantageously, the transparent substrate has a higher refractive index than the refractive index of the OLED layer so as to confine the light within the substrate.

Opaque covers are advantageously arranged on the side faces that do not light the secondary object.

DETAILED DESCRIPTION OF THE INVENTION

It is an object of the present invention to propose a display assembly comprising an organic light-emitting diode (OLED) display device A, used for displaying information on demand to the user, and a secondary object 6 to be illuminated, which makes the best use of the light emitted by one or more OLEDs of OLED display device A, trapped between the faces of the substrate of the device and recovered to illuminate the secondary object 6 associated with the OLED device.

Figure 1:
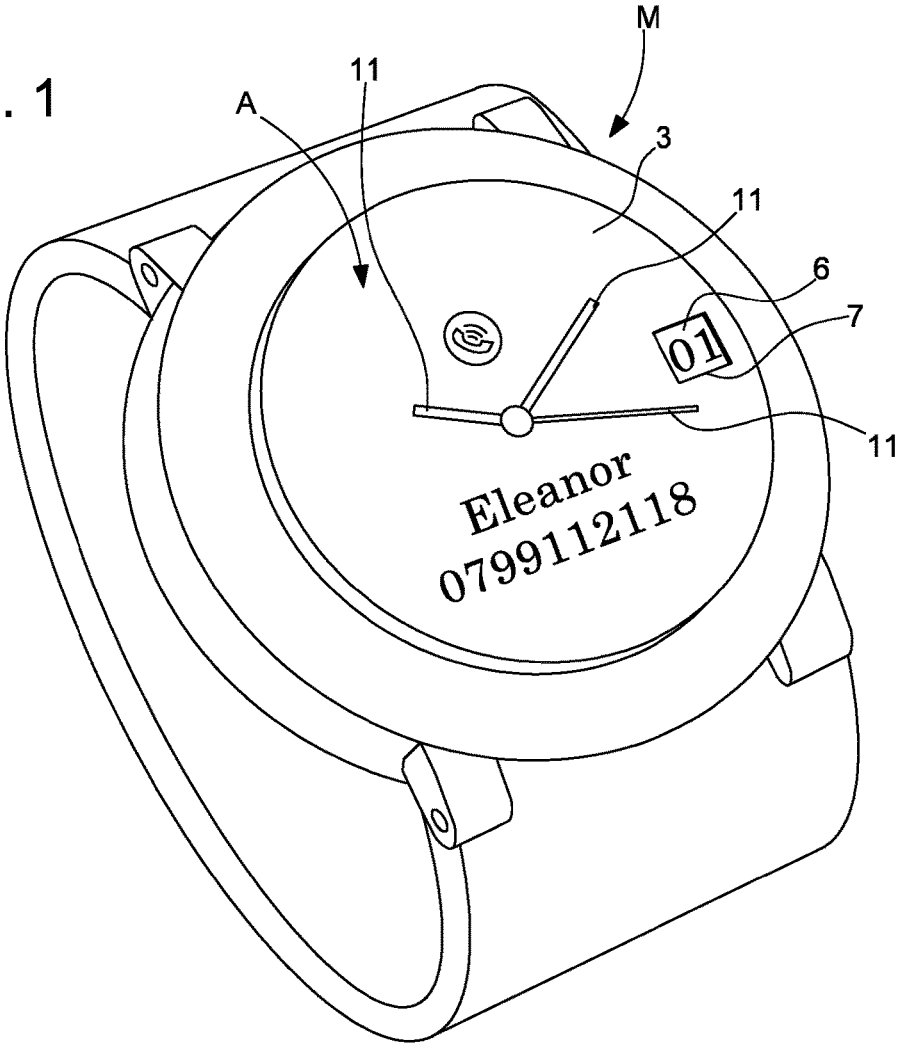
FIG. 1 represents a perspective view of a watch including a display assembly according to the invention.
Figure 2:
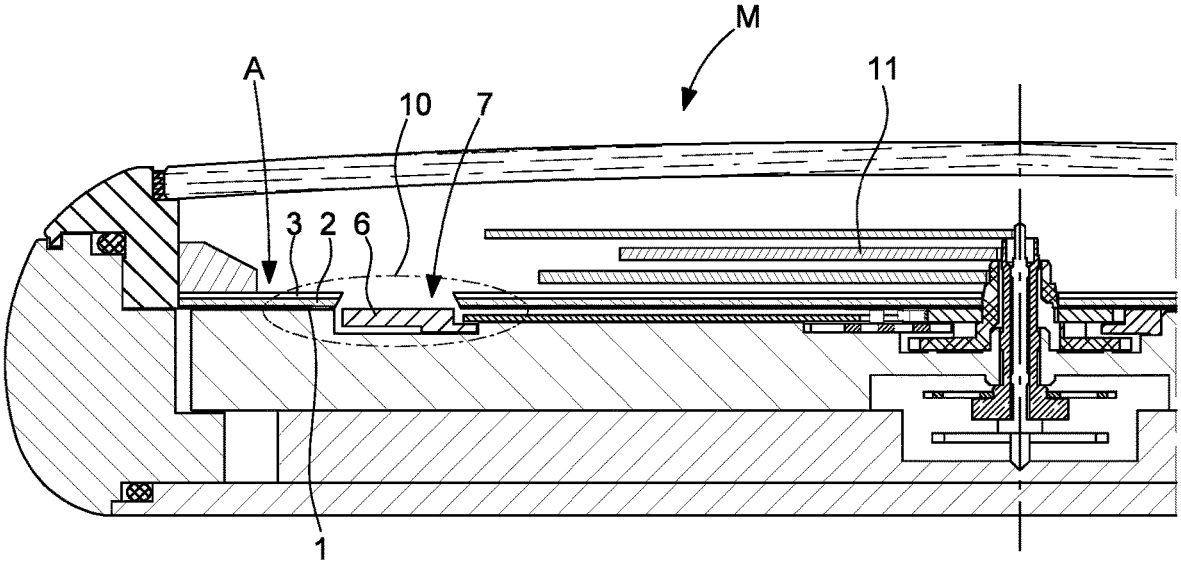
FIG. 2 represents a cross-sectional view of a watch including a display assembly according to the invention represented in FIG. 1.
Figure 3:
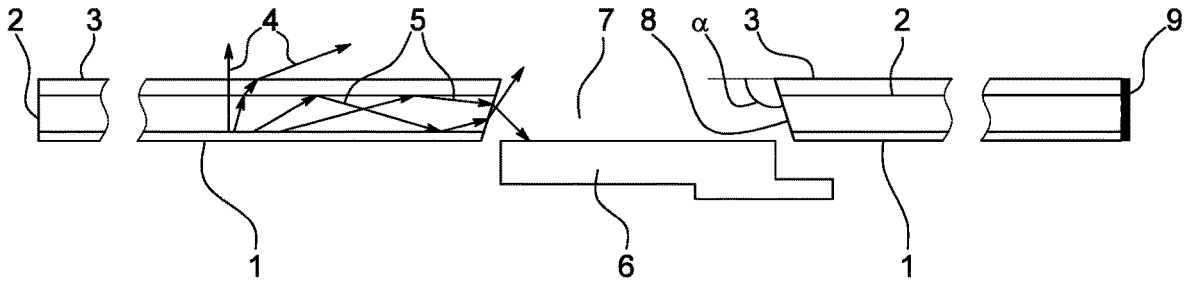
FIG. 3 represents an enlargement of area 10 of FIG. 2.

According to an embodiment of the invention represented in FIGS. 1 to 3, a watch M is shown incorporating a mixed display device comprising an active lighting screen A (backlit, LED or OLED), which can be decorated on the face thereof oriented towards the user, and a passive display comprising a time dial cooperating with hands 11 and a passive display member 6 visible through an aperture 7 arranged in the dial.

As represented in FIG. 3, the display assembly of the invention uses the light trapped by total reflection in a transparent layer 2 of the active display by extracting the light through a side face 8 substantially perpendicular to the main faces or at an angle α comprised between 90° and 135° relative to the front face. The active display device of the invention comprises an emitting layer of the OLED type 1 placed on the back face of transparent substrate 2. This may be an active matrix OLED screen, or a liquid crystal screen (LCD) particularly of the TFT type, associated with a backlight device comprising an OLED or a LED. In this latter case, the light is recovered from the side faces of the light guide of the backlight device. In the present description, this screen is assumed to be the main display.

In such a device, only light 4 emitted by the OLED forming an angle to the surface normal of the display glass lower than the critical angle, can emerge from the front face of the transparent substrate.

According to the invention, part of light 5 trapped between the parallel faces of transparent substrate 2 by total reflection is extracted through at least one side face 8 made in the selected area. This light can then be used to light other elements 6, referred to as secondary elements, such as an analogue time display or a display member visible through aperture 7, for example a date disc 6.

It is possible to modify the ratio between the light emitted by the front face and the light emitted by the edge or side face of the substrate by modifying the refractive index of the substrate: the higher the refractive index of the substrate, the more light will be trapped in transparent layer 2. It may, from this point of view, be advantageous to use a high index substrate 2, such as sapphire, whose refractive index is 1.768.

One or more additional layers 3 can be added to the surface of transparent substrate 2. These layers can, for example, act as anti-scratch, anti-reflective or decorative layers.

Side faces 8 of substrate 2 preferably have a texture that reduces internal reflection, to optimise light extraction. In particular, water jet, grinding or ultrasonic cutting techniques have the advantageous effect of frosting on depolishing the side 8 of substrate 2, thereby improving diffusion and thus the uniformity of light extraction.

Depending upon the position of the secondary object 6 to be illuminated, it may be advantageous to incline lighting side 8. In particular, as represented in FIG. 1, an object slightly set back from the main display, as would be the case of a conventional date display via a mechanically driven date disc (see FIGS. 2 and 3), is, preferably, illuminated by side faces oriented towards this secondary display, which has the additional advantage of reducing the direct view to the user, and therefore of reducing glare.

To prevent undesired illumination, the side faces which do not illuminate a secondary object can advantageously be covered with an opaque, preferably reflective layer 9.

As represented in FIGS. 2 and 3, the organic light-emitting diode (OLED) display device of the invention is advantageously incorporated in mixed watches, comprising a conventional time display including hands 11 and an aperture 7 underneath which a date disc 6 is driven. In such case, the hands are back lit by the main OLED display device which forms a dial located behind the hands, whereas aperture 7 is lit by side faces 8 of aperture 7 arranged in substrate 2 of the organic light-emitting diode (OLED) display device of the invention.

What is claimed is:

1. A display assembly comprising:

an organic light-emitting diode display device including at least one OLED having an emitting stack placed on a transparent, semi-transparent or translucent substrate, a back face of the substrate being placed on the emitting surface of the OLED; and a secondary object to be illuminated, wherein said substrate includes a front face on an opposite side of the substrate from the back face, and at least one side face through which light emitted by the OLED is extracted to light a secondary object, wherein the side face of the substrate extends an entirety of a distance from the front face of the substrate to the back face of the substrate, and wherein the OLED includes a side surface, the side surface of the OLED is arranged immediately adjacent the side face of the substrate.

2. An assembly according to claim 1, further comprising an analogue time display.

3. The assembly according to claim 2, wherein the secondary object includes the analogue time dial.

4. The assembly according to claim 1, wherein the secondary object is arranged inside a watch aperture, the watch aperture being formed by the side surface of each of the OLED and the side face of the substrate.

5. The assembly according to claim 1, wherein said side face is depolished to produce diffused light during use.

6. A positive assembly according to claim 1, wherein said side face is at an angle of between 90 and 135° relative to the front face.

7. An assembly according to claim 1, wherein said transparent substrate has a refractive index of at least 1.5.

8. The assembly according to claim 1, wherein opaque covers are arranged on the side faces that do not illuminate the secondary object.

9. The assembly according to claim 1, wherein the front face of the substrate includes an integrated or added decoration.

10. The assembly according to claim 1, wherein the substrate is suiniounted by a semi-transparent dial.

11. An assembly according to claim 1, wherein said transparent substrate has a refractive index between 1.6 and 1.8.

12. A watch comprising:

a display assembly including an organic light-emitting diode display device having at least one OLED including an emitting stack placed on a transparent, semi-transparent or translucent substrate, a back face of the substrate being placed on the emitting surface of the OLED; and a secondary object to be illuminated, wherein said substrate includes a front face on an opposite side of the substrate from the back face, and at least one side face through which light emitted by the OLED is extracted to light a secondary object, wherein the side face of the substrate extends an entirety of a distance from the front face of the substrate to the back face of the substrate, and wherein the OLED includes a side surface, the side surface of the OLED is arranged immediately adjacent the side face of the substrate.

* * * * *